US005299929A

United States Patent [19]

Yap

[11] Patent Number: 5,299,929

[45] Date of Patent: Apr. 5, 1994

[54] FUEL BURNER APPARATUS AND METHOD EMPLOYING DIVERGENT FLOW NOZZLE

[75] Inventor: Loo T. Yap, Princeton, N.J.

[73] Assignee: The BOC Group, Inc., New Providence, N.J.

[21] Appl. No.: 23,511

[22] Filed: Feb. 26, 1993

[51] Int. Cl.[5] ..... F23C 5/00

[52] U.S. Cl. ..... 431/8; 431/10; 239/423; 239/553.5; 239/556; 239/566; 239/590.5

[58] Field of Search ..... 239/418, 424, 424.5, 239/429, 553.5, 554, 556, 566, 568, 590.5, 597, 423; 431/8, 10, 178, 179

[56] References Cited

U.S. PATENT DOCUMENTS

| | | | |
|---|---|---|---|
| 1,159,249 | 11/1915 | Morton | 239/423 |
| 1,870,066 | 8/1932 | Olson | 239/423 |
| 2,314,078 | 3/1943 | Crawford | 239/590.5 |
| 2,684,690 | 7/1954 | Lee | 239/590.5 |
| 2,864,406 | 12/1958 | Schewel | 239/590.5 |
| 3,685,740 | 8/1972 | Shepherd | 239/424 |
| 4,185,780 | 1/1980 | Duchene et al. | 239/590.5 |

*Primary Examiner*—Carroll B. Dority

*Attorney, Agent, or Firm*—David M. Rosenblum; Larry R. Cassett

[57] ABSTRACT

A burner for burning fuel in an oxidant having a fuel nozzle sandwiched between upper and lower oxidant nozzles. The fuel nozzle and upper and lower oxidant nozzles produce fuel and oxidant jets of outwardly divergent, fan-shaped configuration to provide a wide uniform flame and thus the elimination of hot spots. Upper and lower secondary oxidant nozzles can be provided in staged combustion such that fuel is burned and oxidant supplied by the upper and lower oxidant nozzle means in the substoichiometric ratio and then combustion is completed by oxidant supplied by the secondary upper and lower oxidant nozzles. In another aspect, a nozzle is provided in which a passageway is divided in a lengthwise direction and thus the flow of oxidant flowing through the passageway is divided into a plurality of subflows of equal velocity and of gradually divergent configuration to prevent the decay of a fan-shaped flow of oxidant from the nozzle.

10 Claims, 4 Drawing Sheets 56
60
64
62
4C
4D

FUEL BURNER APPARATUS AND METHOD EMPLOYING DIVERGENT FLOW NOZZLE

BACKGROUND OF THE INVENTION

The present invention relates to a fuel burner apparatus and method for burning a fuel in an oxidant. More particularly, the present invention relates to such a fuel burner apparatus and method in which the oxidant is oxygen or oxygen enriched air. The present invention also relates to a nozzle that is capable of producing a flat, divergent uniform flow of a fluid that is particularly suited for forming oxidant nozzles used in a fuel burner apparatus and method in accordance with the present invention.

Fuel burners are used in many industrial applications in which a material to be processed is melted, for example, glass, copper, aluminum, iron, and steel. In order to maximize the heat available from the fuel, oxy-fuel burners have evolved in which the fuel is burned in oxygen or oxygen enriched air. These burners generally produce flames having a highly concentrated power output which can in turn produce hot spots in the melt. Typically, such burners utilize high velocity oxidant and high mass flow rates of fuel to produce the high power outputs. Taken together, the concentrated heating tends to evolve volatiles within the melt and the high velocities tend to entrain feed material to the exhaust of the furnace. The entrained feed material and evolved volatiles can thereby be lost and pollute the atmosphere or can form a deposit which accumulates within the furnace or exhaust heat recovery systems used in conjunction with furnaces.

A still further problem in oxy-fuel burners is that the high temperature combustion of the fuel in oxygen or oxygen enriched air can produce polluting $NO_x$.

As will be discussed, the present invention provides a burner apparatus and method that is less susceptible than prior art apparatus and methodology to forming hot spots and entraining feed particles within the flow of oxidant and fuel and further, is readily adaptable to employ a $NO_x$ limiting form of combustion.

SUMMARY OF THE INVENTION

The present invention provides a fuel burner for burning fuel in an oxidant comprising fuel nozzle means and upper and lower nozzle means. The fuel nozzle means produces a fuel jet of outwardly divergent, fan-shaped configuration which is adapted to burn within the oxidant with an outwardly extending and divergent flame. The upper and lower oxidant nozzle means are separate and distinct from one another and from the fuel nozzle means for producing upper and lower oxidant jets of outwardly divergent, fan-shaped configuration located above and below the fuel jet, respectively. The oxidant jets have a lower velocity than the fuel jets such that the oxidant is aspirated into the fuel.

In another aspect of the present invention, the present invention provides a method of burning fuel in an oxidant. In accordance with such method a fuel jet is produced of outwardly divergent, fan-shaped configuration so that the fuel jet will burn within the oxidant with an outwardly extending and divergent flame. Upper and lower oxidant jets, separate and distinct from one another and from the fuel jet are produced at locations above and below the fuel jet, respectively, and so as to have a lower velocity than the fuel jet and thereby aspirate oxidant into the fuel.

In these forgoing aspects of the present invention, the fuel jet and oxidant nozzle are outwardly divergent and fan-shaped to produce an outwardly extending flame burning over a wide area. The wide area of combustion has the advantage of permitting high levels of heat input into a melt while eliminating hot spots within the melt. The upper and lower oxidant nozzle means produce low velocity and therefore high pressure oxidant jets which in turn produces a pressure differential to aspirate the oxidant into the fuel. Since, however, the oxidant jets are of low velocity, they tend not to entrain feed particles and thus serve to shield the fuel jet.

In still another aspect, the present invention provides a nozzle for producing a flat, uniformly divergent flow of a fluid. This nozzle is particularly well suited for serving as the upper and lower oxidant nozzle means. The nozzle comprises a body portion including a passageway. The passageway has an outlet for discharging a fluid flow and an inlet to the passageway for introducing the fluid flow into the passageway. A means is provided for dividing the passageway in a lengthwise direction thereof and thus, the flow of the fluid into a plurality of subflows having velocities of essentially equal magnitude and oriented so as to gradually diverge in a transverse direction of the flow of the fluid.

As stated above, the present invention can be adapted to reduce $NO_x$ formation. In prior art oxy-fuel burners, atmospheric nitrogen can react with oxygen to produce thermal $NO_x$. In addition, fuel radicals such as CH can react with atmospheric nitrogen to form prompt $NO_x$. In this aspect of the present invention, combustion of the fuel occurs in two stages in order to reduce both thermal and prompt $NO_x$ formation. In a first of the two stages of combustion, combustion of the fuel within the oxidant supplied by the upper and lower oxidant jets is substoichiometric. The burner further comprises secondary upper and lower oxidant nozzle means separate and distinct from one another and the upper and lower oxidant nozzle and fuel jet means. The upper and lower oxidant nozzle and fuel jet means produce at least one pair of upper and lower secondary oxidant jets of outwardly divergent, fan-shaped configuration located above and below the upper and lower oxidant jets, respectively, for supplying sufficient amounts of oxidant to complete combustion of the fuel. The combustion of the fuel is thereby completed in a second of two stages of combustion. It is to be noted that the sufficient amounts of oxydant can either be just that required to complete combustion or alternatively, can be in superstoichiometric amounts. The methodology involved in this aspect of the present invention comprises producing at least one pair of upper and lower secondary oxidant jets of outwardly divergent, fan-shaped configurations at locations above and below the upper and lower oxidant jets, respectively, so as to supply sufficient amounts of oxydant to complete combustion of the fuel. This staging of combustion has been found to lower $NO_x$ formation.

BRIEF DESCRIPTION OF THE DRAWINGS

While the specification concludes with claims distinctly pointing out the subject matter that Applicant regards as his invention, it is believed that the invention will be better understood when taken in connection with the accompanying drawings in which:

DETAILED DESCRIPTION

Figure 1:
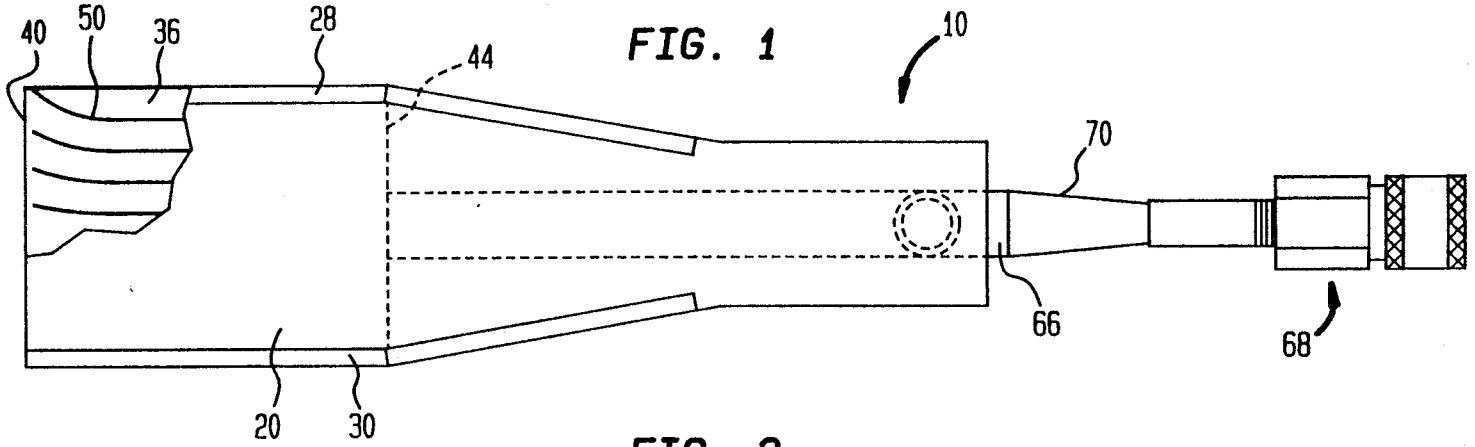
FIG. 1 is a top plan view of a burner in accordance with the present invention.
Figure 2:
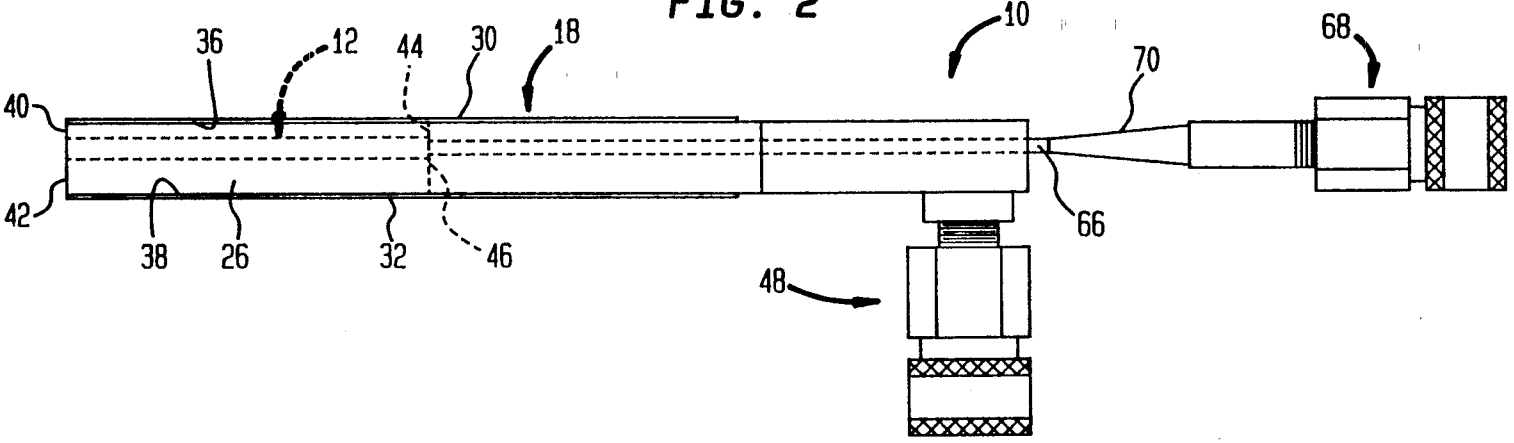
FIG. 2 is an elevational view of FIG. 1.
Figure 3:
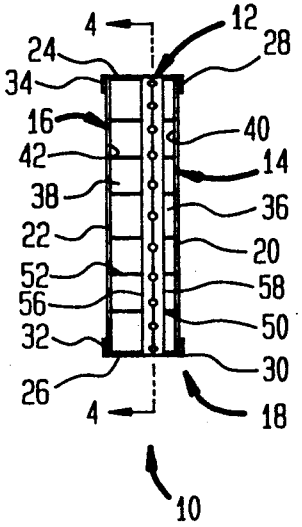
FIG. 3 is a front elevational view of FIG. 1.
Figures 4A, 4B, 4C, 4D:
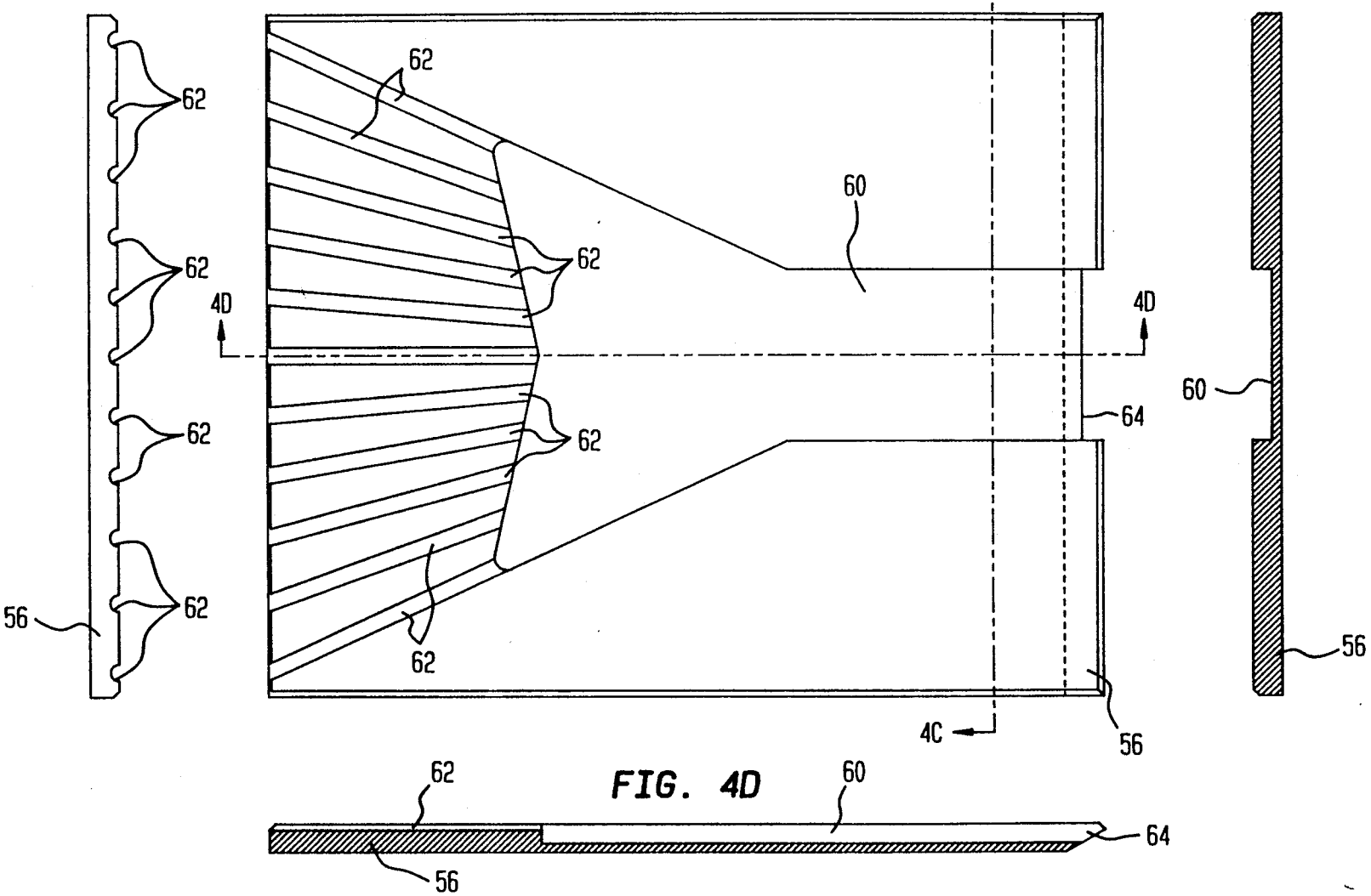
FIG. 4A is a fragmentary or a sectional view taken along line 4—4 of FIG. 3.
FIG. 4B is a fragmentary front elevational view of FIG. 4A.
FIG. 4C is a fragmentary, cross-sectional view taken along line 4C of FIG. 4A.
FIG. 4D is a fragmentary, cross-sectional view taken along line 4D of FIG. 4A.

With reference to FIGS. 1, 2 and 3 a burner 10 in accordance with the present invention is illustrated. Burner includes a fuel nozzle 12, which, as will be described, is designed to produce a fuel jet of outwardly divergent, fan-shaped configuration. Such a fuel jet will burn within suitably shaped oxidant jets with an outwardly extending and divergent flame. Upper and lower oxidant nozzles 14 and 16 are provided for producing upper and lower oxidant jets of outwardly divergent, fan-shaped configuration located above and below the fuel jet. The upper and lower oxidant jets of upper and lower oxidant nozzles 14 and 16 have a lower velocity than the fuel jet. As a result, the oxidant has a higher pressure than the fuel and the oxidant tends to aspirate into the fuel. Thus, in the present invention, a high velocity fuel jet is shielded by low velocity oxidant jets to help prevent the entrainment of feed that would otherwise occur with burners of the prior art. Burner 10 is specifically designed to burn natural gas in an oxidant of essentially pure oxygen. It is understood that more generally the teachings set forth herein have applicability to different fuel gases such as hydrogen, ethane, propane, butane, acetylene and liquid fuels such as diesel fuel, heating oils, etc. Additionally the oxidant can be oxygen enriched air.

As can be appreciated, the fuel burns along the length of the flame and oxidant jets. As such, unburned fuel is heated and becomes progressively more buoyant along the length of the flame, causing the flame to lick upwardly, away from the heat load. In order to prevent this, lower oxidant nozzle means 16 can be designed such that the lower oxidant jet has a higher mass flow rate than that of the upper oxidant jet issuing from upper oxidant nozzle 14. This will result in the combustion of the fuel being primarily in oxidant supplied by the lower oxidant jet of higher mass flow rate with the increasingly more buoyant unburned fuel burning in the oxidant supplied by the upper oxidant jet. As can be appreciated, an embodiment of the present invention could be constructed with upper and lower oxidant nozzles producing oxidant jets of equal mass flow rates.

Burner 10 is provided with a body 18 of elongated configuration having top and bottom walls 20 and 22 and side walls 24 and 26. Angled reinforcement members 28-34 are provided to stiffen body portion 18. Central fuel nozzle 12 divides body portion 18 into upper and lower oxidant nozzles 14 and 16 which include upper and lower passageways 36 and 38 having outlets 40 and 42 and inlets 44 and 46.

A coupling assembly 48 is connected to the rear of body portion 18 to introduce oxidant into body portion 18 which in turn flows into inlets 44 and 46 of upper and lower oxidant nozzles 14 and 16 and thereafter, flows of outlets 40 and 42 thereof.

Fuel nozzle 12 is supported within body 18 by upper and lower sets of vanes 50 and 52. Vanes 50 and 52 are connected to top and bottom walls 20 and 22 and to fuel nozzle 12. Vanes 50 and 52 divide passageways 36 and 38 in the lengthwise direction and therefore the flow of oxidant passing through upper and lower passageways 36 and 38 into a plurality of subflows. Vanes 50 and 52 are specifically designed such that the velocities of the subflows will have an essentially equal magnitude and be oriented so as to gradually diverge in a transverse direction to the flow of the oxidant. This is effectuated by outwardly curving vanes 50 and 52 which are designed such that tangents drawn at their maximum curvatures all intersect at one location within the respective of the passageways 40 and 42 of which vanes 50 and 52 subdivide. Although hidden, the vanes extend rearwardly to the inlets 44 and 46 of upper and lower oxidant nozzles 14 and 16. A further advantage of the vaned upper and lower oxidant nozzles is that the vanes allow for effective self cooling of burner 10 without external water cooling.

As stated previously, upper and lower oxidant nozzles 14 and 16 are designed such that the lower oxidant jet will have a higher mass flow rate than the upper oxidant nozzle jet. This is effected by appropriately sizing the rectangular, transverse cross-section of upper and lower oxidant nozzles to be in a ratio of cross-sectional areas smaller than unity. The ratios are preferably in a range of between about 0.125 and about 0.5.

It is to be noted here that the design of oxidant nozzles 14 and 16 could be used in other applications. For instance, an oxidant nozzle could be designed in the manner provided herein for use in creating a flat, fan-shaped outwardly divergent field of oxidant below a fuel jet or burner or in other words, for oxygen-lancing purposes.

With reference to FIGS. 4A through 4D, fuel nozzle 12 is preferably formed in two sections 56 and 58. Fuel nozzle 12 is in the form therefore of a central body portion having a chamber 60 and a plurality of passageways 62 of equal length, spaced apart from one another, and gradually fanning out from chamber 60. Chamber 60 communicates between passages 62 and a fuel inlet 64 such that fuel flows from fuel inlet 64 and out of passages 62. Passages 62 gradually fan out from chamber 60 so that the resultant fuel jet will fan out. The equal length of passages 62 produce an equal pressure drop and therefore equal velocity so that the fuel jet will fan out or horizontally diverge with little decay. In the illustrated embodiment the ratio of the average velocities of the fuel versus oxidant is approximately 13.5 to 1.0. A conduit 66 of rectangular-transverse cross-section connects to a coupling 68 by means of a transition piece 70 which transitions from a circular, transverse cross-section to a rectangular, transverse cross-section. If fuel nozzle 12 were to be employed to burn liquid fuels, suitable fuel nozzles (known well in the art) would have to be attached to passages 62.

Figure 5:
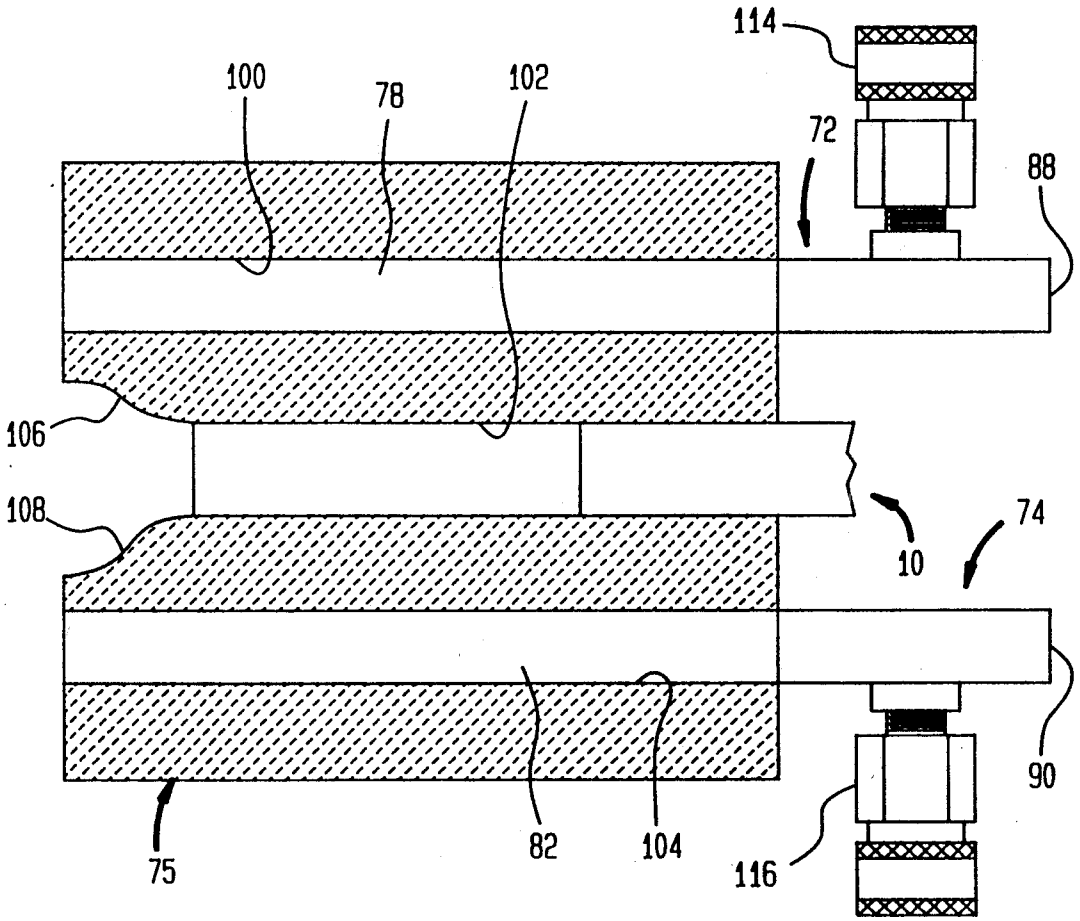
FIG. 5 is a fragmentary side elevational view of another embodiment of a burner in accordance with the present invention employing oxidant staging and illustrated as being set in a burner block shown in section.
Figure 6:
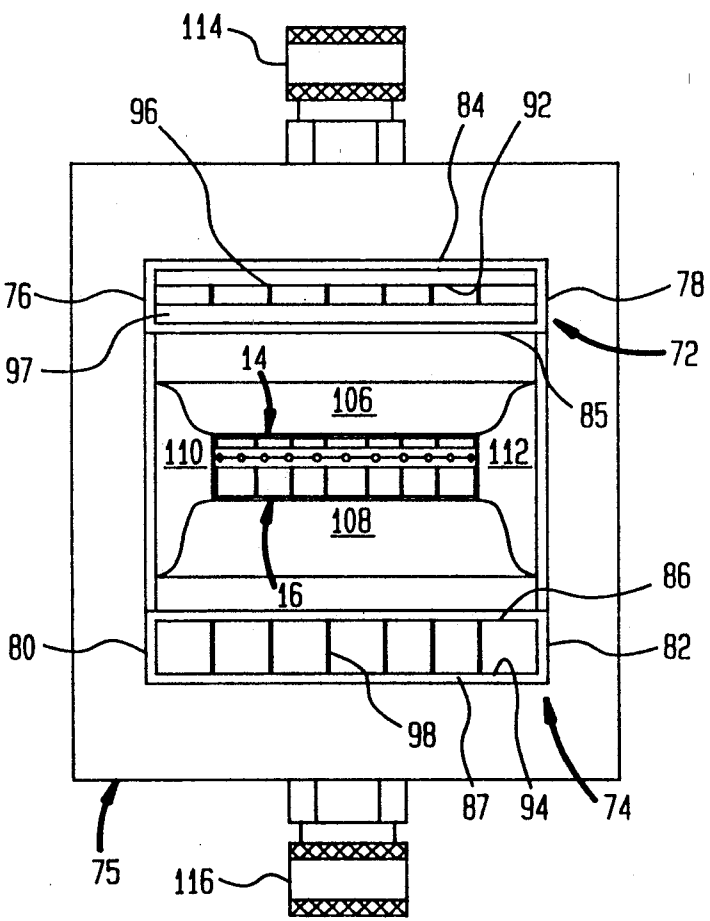
FIG. 6 is a front elevational view of FIG. 5.
Figure 8:
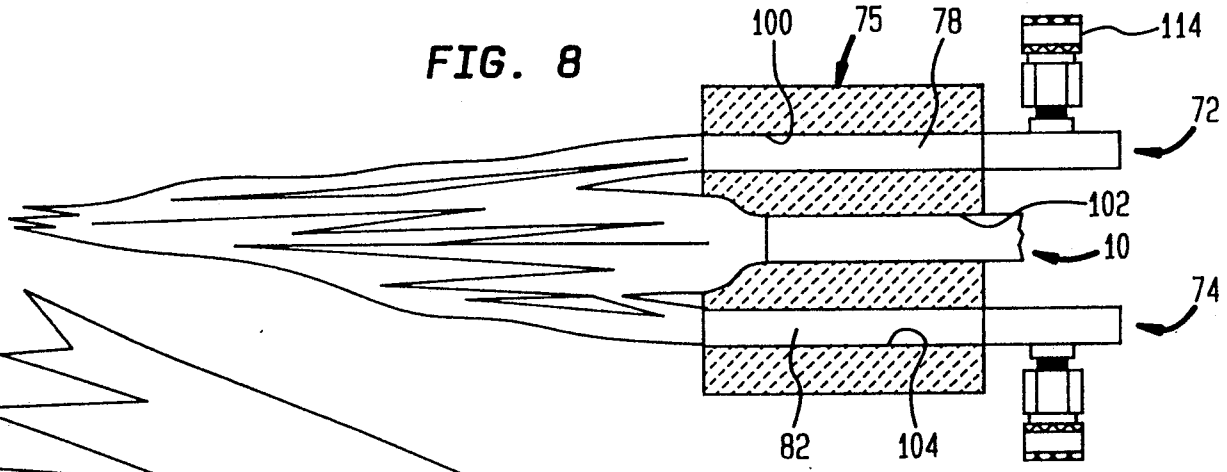
FIG. 8 is an elevational view of a flame issuing forth from the burner of FIG. 5 with the burner block being drawn in section.
Figure 9:
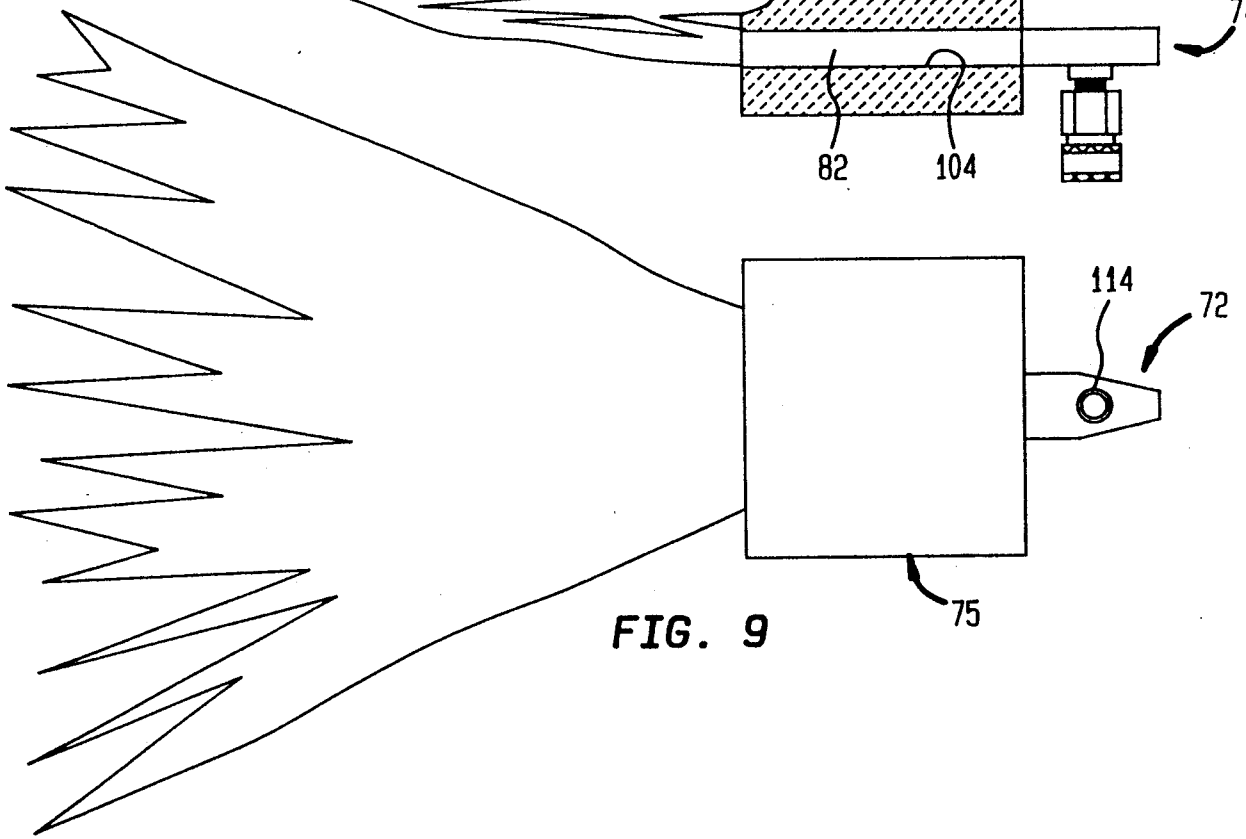
FIG. 9 is a top planar view of FIG. 8.
Figure 7:
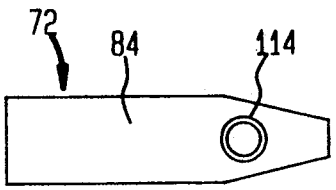
FIG. 7 is a top planar view of a nozzle employed in the burner of FIG. 5.

With reference now to FIGS. 5, 6 and 7 an alternative embodiment of a fuel burner apparatus of the present invention is illustrated. The illustrated embodiment stages oxidant into the fuel to reduce poluting $NO_x$ emissions while producing a flame pattern illustrated in FIGS. 8 and 9 which is horizontally divergent, fan-shaped and resistant to decay along the length of the flame pattern. This is effected with the use of burner 10 such that fuel and oxidant is supplied from oxidant nozzles 14 and 16 in substoichiometric amounts or in other words the oxidant supplied does not completely support combustion of the fuel. Thereafter, combustion of fuel is completed in upper and lower secondary oxidant jets of outwardly divergent, fan-shaped configuration supplied at locations above and below the upper and lower oxidant jets, respectively, by upper and lower secondary oxidant nozzles 72 and 74 set within a burner block 75 along with burner 10. The incomplete combustion occurs in a first stage of the combustion and the completed combustion occurs in a second stage of the combustion located downstream from the first stage of the combustion. As discussed above the two stage combustion contemplated by the present invention tends to reduce $NO_x$ emissions. Additionally, $NO_x$ emissions are also lowered by the spacing of passages 62 of fuel nozzle 12. The spaces between passages 62 permit recirculation zones to aspirate combustion gases into the fuel and thereby reduce $NO_x$ emissions.

Upper and lower secondary oxidant nozzles 72 and 74 have opposed side walls 76 and 78 (for upper secondary oxidant nozzle 72) and 80 and 82 (for lower secondary oxidant nozzle 74) connected to sets of top and bottom walls 84, 85, 86 and 87 are provided which are connected to side walls 76 and 78 and 80 and 82 of upper and lower secondary oxidant nozzles 72 and 74, respectively. The nozzles are also provided with back walls 88 and 90. Nozzles 72 and 74 are also provided with rectangular discharge outlets 92 and 94 and vanes 96 and 98 having the same configuration as vanes 34 and 36 of upper and lower nozzles 14 and 16. Although discharge outlets 92 and 94 are designed to inject oxidant in the same ratio as upper and lower nozzles 14 and 16, an embodiment of the present invention is possible in which discharge outlets 92 and 94 have the same cross-sectional area and therefore possibly not in the same ratio of upper and lower nozzles 14 and 16. In the illustrated embodiment, nozzle 72 is provided with a front wall 97 within which discharge outlet 92 is defined.

Nozzles 72 and 74 and burner 10 are set within passages 100, 102, and 104 provided in burner block 75. It should be noted that passage 102 recesses burner 10 from nozzles 72 and 74 to allow for the downstream injection of oxidant by nozzles 72 and 74 and therefore the second stage of combustion. Furthermore, the surfaces 106, 108, 110, and 112 of burner block 75, located in front of burner 10 and forming the front of passage 102, are designed to allow the flame produced by burner 10 to gradually diverge.

Conventional quick-disconnect fittings 114 and 116 are connected to upper and lower secondary oxidant nozzles 72 and 74, respectively, for introducing the secondary oxidant into the upper and lower secondary oxidant nozzles 72 and 74, respectively.

While the invention has been described with reference to preferred embodiment, it would be understood that numerous additions and omissions can be made without departing from the spirit and scope of the invention.

I claim:

1. A burner for burning fuel in an oxidant comprising:

a fuel nozzle means for producing a fuel jet of outwardly divergent, fan-shaped configuration, the fuel jet adapted to burn within the oxidant with an outwardly extending and divergent flame; and upper and lower oxidant nozzle means separate and distinct from one another and from the fuel nozzle means for producing upper and lower oxidant jets of outwardly divergent, fan-shaped configuration located above and below the fuel jet, respectively, and having a lower velocity than the fuel jet such that the oxidant is aspirated into the oxidant.

2. The burner of claim 1, wherein:

unburned fuel becomes progressively more buoyant along the length of the flame; and the lower oxidant jet has a higher mass flow rate than that of the upper oxidant jet such that combustion of the fuel is primarily in oxidant supplied by the lower oxidant jet and the increasingly more buoyant unburned fuel burns in oxidant supplied by the upper oxidant jet.

3. The burner of claim 1, wherein the combustion of the fuel within the oxidant supplied by the upper and lower oxidant jets is substoichiometric an occurs in a first stage of the combustion; and the burner further comprises secondary upper and lower oxidant nozzle means separate and distinct from one another and the first mentioned upper and lower oxidant nozzle and fuel jet means and producing at least one pair of upper and lower secondary oxidant jets of outwardly divergent, fan-shaped, configuration located above and below the first mentioned upper and lower oxidant jets, respectively, for supplying sufficient amounts of oxidant to complete combustion of the fuel in a second stage of the combustion located downstream from the first stage of the combustion.

4. The burner of claim 1, wherein each of the upper and lower oxidant nozzle means has, a passageway having an outlet for discharging the oxidant and an inlet to the passageway for introducing a flow of the oxidant into the passageway; and means dividing the passageway in a lengthwise direction thereof and the flow of the oxidant into a plurality of subflows having an essentially equal magnitude and oriented so as to gradually diverge in a transverse direction to the flow of the oxidant.

5. The burner of claim 4, wherein:

the passageway is of rectangular transverse cross-section; and the fuel jet means comprises a central body portion having, a chamber, a fuel inlet to the chamber, and a plurality of passages of equal length spaced apart from one another and gradually fanning out from the chamber such that fuel flows from the fuel inlet into the chamber and then out of the passages with an equal pressure drop and therefor velocity to merge and produce the fuel jet.

6. The burner of claims 4 or 5 wherein the passageway dividing means comprises a plurality of outwardly curving vanes.

7. The burner of claims 4 or 5 wherein:

unburned fuel becomes progressively more buoyant along the length of the flame; and the rectangular transverse cross-section of the passageway of the lower oxidant nozzle means has a greater area than than of the upper oxidant nozzle means so that the lower oxidant jet will have a higher mass flow rate than the upper oxidant nozzle jet such that combustion of the fuel is primarily in the oxidant supplied by the lower oxidant jet and the increasingly more buoyant unburned fuel burns in the oxidant supplied by the upper oxidant jet.

8. A method of burning fuel in an oxidant comprising:

producing a fuel jet of outwardly divergent, fan-shaped configuration so that the fuel jet will burn within the oxidant with an outwardly extending and divergent flame; and producing upper and lower oxidant jets separate and distinct from one another and from the fuel jet at locations above and below the fuel jet, respectively, and so as to have a lower velocity than the fuel jet such that the oxidant is aspirated into the fuel;

9. The burner of claim 8, wherein:

unburned fuel becomes progressively more buoyant along the length of the flame; and the lower oxidant jet has a higher mass flow rate than that of the upper oxidant jet such that combustion of the fuel is primarily in oxidant supplied by the lower oxidant jet and the increasingly more buoyant unburned fuel burns in oxidant supplied by the upper oxidant jet.

10. The burner of claim 8, wherein the combustion of the fuel within the oxidant supplied by the upper and lower oxidant jets is substoichiometric and constitutes a first stage of the combustion; and the method further comprises producing at least one pair of upper and lower secondary oxidant jets of outwardly divergent, fan-shaped configuration at locations above and below the upper and lower oxidant jets, respectively, so as to supply sufficient amounts of oxidant to complete combustion of the fuel in a second stage of the combustion located downstream of the first stage of the combustion.

* * * * *